United States Patent [19]

Kim

[11] Patent Number: 4,648,598

[45] Date of Patent: Mar. 10, 1987

[54] GOLF CLUB WITH AIR PERMEABLE SHAFT

[76] Inventor: Sung B. Kim, Rt. 20, Sampson Rd., P.O. Box 220, Charlton, Mass. 01507

[21] Appl. No.: 746,070

[22] Filed: Jun. 18, 1985

[51] Int. Cl.[4] ..... A63B 53/12; A63B 53/10

[52] U.S. Cl. ..... 273/80 R; 273/167 E; 273/81 B; 428/36

[58] Field of Search ..... 273/80 R, 80 B, 80 A, 273/73 J, 167 E, 72 R, 72 A, 73 K, 75, 73 H, 67 R, 67 A, 67 C, 67 DA, 67 DB, 80.9; 428/36

[56] References Cited

U.S. PATENT DOCUMENTS

| | | | |
|---|---|---|---|
| 404,899 | 6/1889 | Corey | 273/73 H |
| 1,169,667 | 1/1916 | Meguyer | 273/80 B |
| 1,367,492 | 2/1921 | Miles | 273/72 R |
| 1,381,050 | 6/1921 | Agutter | 273/73 K |
| 1,414,124 | 4/1922 | Griffin | 273/167 E |
| 3,633,910 | 1/1972 | Spenle | 273/73 J |
| 3,806,133 | 4/1974 | Cork | 273/80 R |
| 3,813,098 | 5/1974 | Fischer et al. | 273/72 R |
| 4,407,500 | 10/1983 | Hofmann | 273/75 |

FOREIGN PATENT DOCUMENTS

| | | | |
|---|---|---|---|
| 521360 | 5/1940 | United Kingdom | 273/80 B |
| 773162 | 4/1957 | United Kingdom | 273/80 R |

*Primary Examiner*—George J. Marlo
*Attorney, Agent, or Firm*—Natter & Natter

[57] ABSTRACT

A golf club includes a skeletal air-permeable frame formed of a plurality of spaced apart rods concentrically arranged about a longitudinal axis. At least one tie member integrally interconnects the rods to provide structural rigidity and maintain the spacing between adjacent rods. The tie member is spirally wrapped about the frame and is joined to individual rods at intersections by welding or bonding. The rods and tie member may be formed of solid or hollow wire having a diameter between 3/1000 of an inch to 4/100 of an inch, and a typical shaft includes from five to thirty rods. The rods may be constructed of conventional metals such as stainless steel, titanium and the like, as well as epoxy impregnated graphite, Fiberglas, polycarbonates and the like.

25 Claims, 9 Drawing Figures

GOLF CLUB WITH AIR PERMEABLE SHAFT

FIELD OF THE INVENTION

The present invention relates generally to golf clubs and more particularly to an improved golf club having a shaft with minimized wind resistance.

BACKGROUND OF THE INVENTION

The golfing arts have been prolific with attempts at improvements of many kinds. While some improvements were directed toward the structure of the ball, various golf clubs have been proposed for betterment of one's game. Some clubs featured lighter weighted shafts constructed of, for example, aluminum and graphite. It has also been suggested that clubs employ shafts constructed of rods for the purpose of reducing weight and rigidifying the shaft structure in U.S. Pat. Nos. 1,917,794 issued July 11, 1933; 3,457,962 issued July 29, 1969; and 3,998,458 issued Dec. 21, 1976.

It has been additionally suggested in U.S. Pat. No. 1,418,038 issued May 30, 1922 to provide a golf club with a shaft having a wire wrapped about the periphery of the shaft shell for the purpose of reducing noise resulting from the swing of the club.

A golf club which features a slotted shaft for providing improved shaft torsional strength was disclosed in U.S. Pat. No. 1,169,667 issued Jan. 25, 1966.

In British Pat. No. 926,165 published May 15, 1963 a golf club shaft was illustrated constructed of resilient metal rods secured to one another in side by side relationship. The use of such rod arrangement for the golf shaft was suggested for the purpose of improved flexibility along the swing axis.

All of the foregoing proposed improvements attempted to provide increased mechanical strength for the club shaft in some way or other. None of the proposed devices, however, dealt with attempts at improving a player's game by providing a club shaft structure which would exhibit reduced wind resistance during swing. It appeared to the inventor that reducing wind resistance or drag of a golf club during swing will increase club speed and momentum. In the art of golf, it occurred to the inventor that a shaft which is capable of faster speeds with the same or reduced effort will drive a ball further than a club of the prior art. Naturally, a club which has greater inertia will drive a ball a greater distance and substantially improve one's game.

DISCLOSURE OF THE INVENTION

A golf club includes a shaft comprised of an air permeable skeletal frame having spaced longitudinal rods concentrically arranged about a longitudinal axis. Air passes around the rods during the swing of the golf club and thus reduces wind resistance, friction or drag, all of which tend to retard shaft motion.

At least one tie rod or wire joins the longitudinal rods to provide structural strength to the shaft. The tie member is spirally wrapped about the lontitudinal rods and is joined at each intersection with a lontitudinal rod by a weld. Multiple tie members can be employed in an undulating sinusoidal wave pattern or in zigzag patterns.

The shaft frame is preferably tapered from a larger diameter upper section over which is secured a club grip to a smaller diameter lower section which is secured to the golf club head.

The tie members may be formed of rods of a diameter equal to that of the longitudinal rods. The longitudinal rods and tie members can be formed of solid or hollow wire or like material having a diameter within a range of 0.003 inches to 0.04 inches with the shaft being formed of from 5 to 30 longitudinal rods. The rods may be constructed of various ccnventional metals such as stainless steel, titanium, etc., as well as epoxy impregnated graphite, Fiberglas, polycarbonates, and even ceramics.

From the foregoing compendium, it will be appreciated that it is an aspect of the present invention to provide an improved golf club of the general character described which is not subject to the disadvantages of the background art aforementioned.

It is a further feature of the present invention to provide an improved golf club of the general character described having a shaft with reduced wind resistance.

Another aspect of the present invention is to provide an improved golf club of the general character described having reduced weight.

A further aspect of the present invention is to provide an improved golf club of the general character described having an air permeable shaft.

An additional aspect of the present invention is to provide an improved golf club of the general character described which provides increased golf head inertia without requiring increased player energy input.

Yet another aspect of the present invention is to provide an improved golf club of the general character described which includes a skeletal frame formed of a plurality of spaced apart longitudinal rods.

A further feature of the present invention is to provide an improved golf club of the general character described having a shaft formed of a plurality of hollow rods.

Other aspects and features of the invention in part will be obvious and in part will be pointed out hereinafter.

The invention accordingly consists in the features of construction, combinations of elements and arrangements of parts which will be exemplified in the improved golf club hereinafter described and of which the scope of application will be indicated in the appended claims.

BRIEF DESCRIPTION OF THE DRAWINGS

In the accompanying drawings in which are shown some of the various possible exemplary embodiments of the invention.

Figure 1:
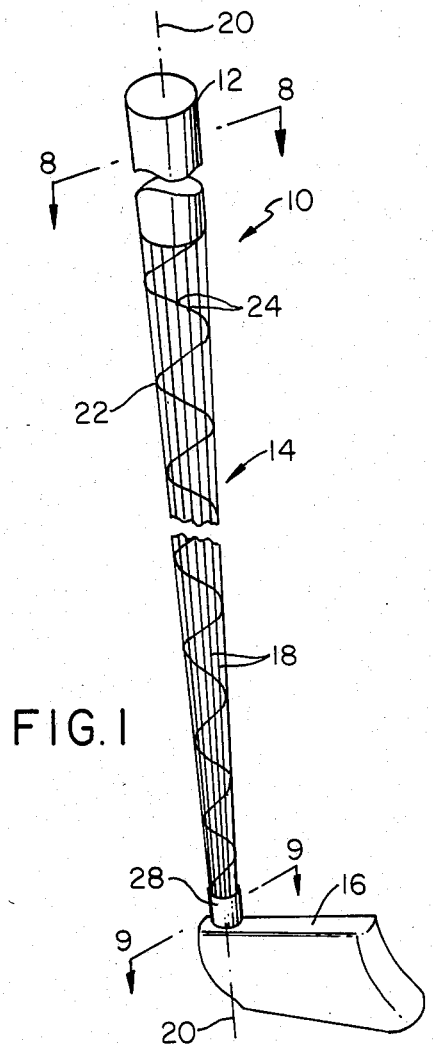
FIG. 1 is a perspective view of an improved golf club constructed in accordance with and embodying the present invention and showing an air permeable skeletal shaft extending between a grip at its upper end and a golf club head at its lower end.
Figure 5:
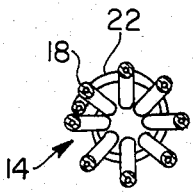
FIG. 5 is a sectional view through the shaft, the same being taken substantially along the plane 5—5 of FIG. 2 and showing, in an illustrative manner, a plurality of tubular longitudinal rods.
Figure 6:
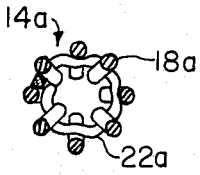
Figure 7:
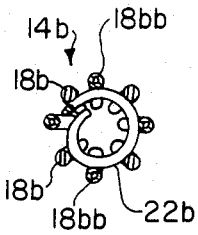
Figure 8:
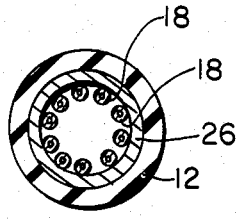
Figure 9:
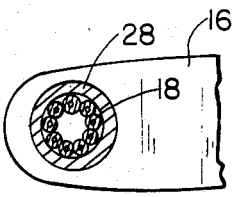

FIG. 6 is a transverse sectional view through the shaft similar to that of FIG. 5 and showing an alternate embodiment wherein the longitudinal rods are formed of solid material and also showing a spiral tie member which is woven between adjacent longitudinal rods;

FIG. 7 is a transverse sectional view similar to that of FIG. 5 yet showing a further embodiment of the invention wherein some of the longitudinal rods are formed of solid material and some of the longitudinal rods are formed of tubular material; additionally shown is a variant tie member configuration wherein the tie member is spiralled along the interior surfaces of the shaft;

FIG. 8 is a transverse sectional view through the golf club of FIG. 1, the same being taken substantially along the plane 8—8 of FIG. 1 and showing the upper end of the skeletal frame being secured in a hollow tubular core over which a yieldable grip is mounted; and FIG. 9 is a sectional view taken substantially along the plane 9—9 of FIG. 1 and through a hollow stem extending from the club head and into which the tapered tip of the skeletal frame is inserted and secured.

DESCRIPTION OF THE PREFERRED EMBODIMENTS

Generally speaking, the invention relates to an improved golf club having an air permeable skeletal shaft construction which minimizes air resistance or drag of the shaft when the club is swung. The club includes a shaft which is comprised of a plurality of spaced apart longitudinal rods which are structurally bound in spaced apart relationship by at least one tie member. The rods may be formed of metal wire such as piano wire, stainless steel, or plastics, epoxy impregnated graphite, Fiberglas, and other materials and may be formed of solid or tubular configuration. At each juncture of a longitudinal rod and a cross member, the cross member and rod are bonded or welded.

Air passes between the rods and through the skeletal shaft frame during a golf swing thus reducing drag or wind resistance which would otherwise retard the swing and reduce momentum. The skeletal shaft frame is dimensionally similar to a common shaft shell, and a conventional grip and club head are secured to the respective ends of the shaft.

Referring now in detail to the drawings, the reference numeral 10 denotes generally a golf club constructed in accordance with and embodying the invention. For the purposes of illustration only, the club head is shown as an iron; however many other clubs embodying the invention can be constructed, such as woods, putters and the like. The club 10 includes a grip 12 at one end of a tapered skeletal shaft 14 and a club head 16 fixed to the other end.

The shaft 14 is comprised of a plurality of spaced apart rods 18 concentrically arranged about a longitudinal axis 20 which runs through the golf club shaft 14 from the grip 12 to the head 16. The rods 18 form a tapered column having a generally circular cross-section and are constructed of strong yet resilient material such as piano wire, spring steel, stainless steel, titanium, etc., as well as epoxy impregnated graphite, Fiberglas, and a variety of plastics. In addition, the rods may be formed of a thin metal core of wire or the like covered with a sheath of thermoplastic or epoxy.

In accordance with the invention, the rods are spaced from one another to permit air to pass between the rods and through the shaft 14 during a golf swing, thus reducing the wind resistance or drag forces which would normally be incurred during the swing of a golf club. Due to the tapered configuration of the shaft 14, it should be appreciated that the spaces between the rods 18 will be greater at the upper or grip end of the club than at the golf head end. Generally speaking, the space between each rod rod should be at least a distance as great as the thickness of each rod over a span of at least the upper two thirds of the shaft.

Figure 2:
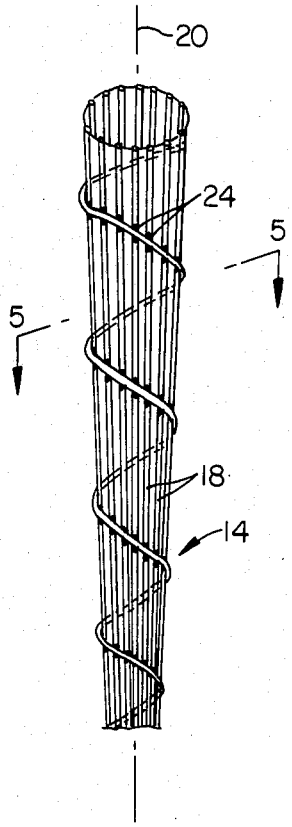
FIG. 2 is an enlarged fragmentary view of a portion of the shaft shown in FIG. 1 with the grip and club head deleted and showing a plurality of rods and a spiral tie member.

To provide structural reinforcement for the shaft 14, a tie member 22 is spirally wrapped about the rods 18 from the grip 12 to the club head 16. The tie member 22 can be formed of a rod having the same thickness and formed of the same material as the rods 18 and is bonded or welded to the rods 18 at each intersection 24 of the tie member and a rod as is illustrated in FIG. 2. If the rods 18 and the tie member 22 are metal, spot welding may be employed; whereas if they are constructed of plastics, suitable bonding such as solvent bonding may be utilized. Additionally, epoxy bonding may be employed for an epoxy-coated, epoxy impregnated graphite or Fiberglas epoxy rods and tie members.

The grip 12 may be secured to the upper end of the shaft 14 through a variety of fastening systems. For example, the rods 18 can be embedded into the grip 12 or the grip 12 may be molded about the upper end of the shaft 14. Illustrated in FIG. 8 is a securement system for the grip wherein the upper ends of the rods 18 are welded or bonded to a metal sleeve 26 over which the grip 12 is seated.

The club head 16 is secured to the lower end of the shaft 14 through any number of similar securement systems. Illustrated in FIG. 1 is a mounting stem 28 which projects upwardly from the club head 16. The stem 28 may comprise a hollow cylindrical projection within which the rods 18 at the lower end of the shaft 14 are forced. The portion of the shaft 14 inserted into the stem 28 may be secured by any suitable system such as mechanical welding, swaging, or bonding with epoxies or other materials.

From the sectional view of FIG. 5, it will be appreciated that the rods 18 are shown as comprised of tubular metal having a hollow bore. It should be appreciated that such is merely an illustrative embodiment. The rods 18 may similarly be formed of a thin metal wire core coated with a suitable plastic.

In FIG. 6, an alternate configuration of the invention is shown wherein like numerals designate like components of the embodiment previously described bearing the suffix "a" however. In this embodiment, a plurality of rods **18*a* are shown in an exemplary manner to be formed of solid material, e.g. metal. This embodiment differs from that of the prior embodiment in an additional feature with respect to the manner in which a tie member 22*a* is wrapped about the rods 18*a*. It will be observed from FIG. 6 that the tie member 22*a* is woven in an undulating pattern alternately on the inside and outside of adjacent rods 18*a***.

In a further embodiment of the invention illustrated in FIG. 7, like numerals refer to like components of the embodiments previously described bearing, however, the suffix "b". In this embodiment, a plurality of rods **18*b* and 18*bb* are formed of solid and tubular material, respectively. In addition, in this embodiment, a tie member 22*b* overlies the rods 18*b* on the interior face of the shaft 14** rather than on its exterior face.

Figure 3:
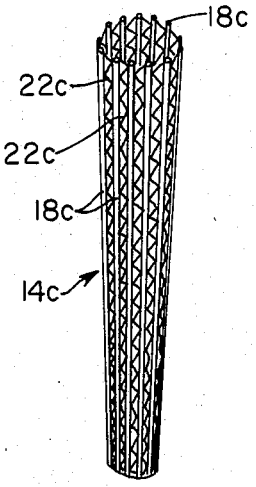
FIG. 3 is a further enlarged fragmentary view of a club shaft of an alternate embodiment of the invention wherein a plurality of tie members are employed in a zigzag configuration.

In FIG. 3, a still further embodiment of the invention is illustrated wherein an alternate configuration of tie members is provided. In this embodiment, like numerals will be employed to denote like components of the embodiments previously described bearing, however, the suffix "c". This embodiment is substantially similar to the embodiments previously described, however multiple tie members 22c are employed with each tie member having a zigzag configuration and spanning between only two adjacent rods 18c.

Figure 4:
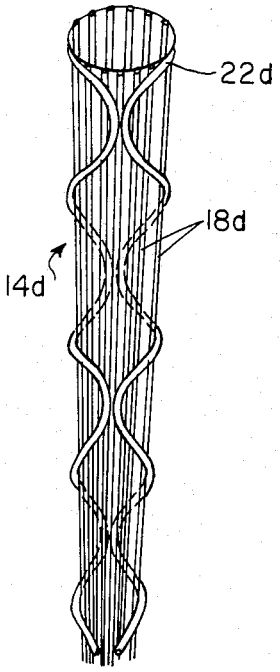
FIG. 4 is a fragmentary view of a still further embodiment of the shaft wherein a pair of tie members are employed in a sine wave configuration.

In FIG. 4, a still further embodiment of the invention is disclosed and like numerals will be employed to denote like components of the previous embodiments bearing, however, the suffix "d". In this embodiment a plurality of rods 18d are employed and are tied together through a pair of tie members 22d, each being configured in a sine wave pattern and spanning across one half of the total number of rods forming the shaft 14.

It should be appreciated that with respect to all embodiments disclosed, the rods and tie member(s) are of a thickness within a range of 3/1000 of in inch to approximately 4/100 of an inch, and a shaft 14 may be formed of from approximately five to approximately thirty rods suitably joined by one or more tie members.

The tie member 22 serves to maintain the spaced relationship between the rods 18 in the presence of forces generated during play and provides a unitary coaction of all of the rods 18 as a single composite shaft which exhibits desired flexure and torsional characteristics.

Thus, it will be seen that there is provided a golf club with an air permeable shaft which accomplishes the various features, aspects and considerations of the present invention and which is well suited to meet the conditions of practical usage.

As various modifications might be made in the invention above set forth, it is to be understood that all matter herein described or shown in the accompanying drawings is to be interpreted as illustrative and not in a limiting sense. For example, the air permeable shaft of the present invention is suited for implementation not only in golf clubs but other sporting implements wherein reduced weight or reduced wind resistance is desirable.

Having thus described the invention, there is claimed as new and desired to be secured by Letters Patent:

1. A golf club having reduced wind resistence during the swing thereof, said golf club comprising head means for striking a golf ball, a grip and a shaft, the shaft being secured to the grip adjacent one end thereof and being secured to the head means adjacent the opposite end thereof, the shaft comprising a skeletal air permeable frame, the frame including from five to thirty spaced apart rods arranged longitudinally about a longitudinal axis, the longitudinal axis extending from the grip to the head means and means integrally interconnecting the rods for providing unitary coaction of the rods as a single club shaft, the interconnecting means including at least one continuous tie member spanning at least two adjacent rods at a plurality of spaced intersections along the length of each of the two rods and means unitarily joining the tie member to each of the rods.

2. A golf club constructed in accordance with claim 1 wherein the tie member is oriented transversely with respect to the rods.

3. A golf club constructed in accordance with claim 1 wherein the tie member is configured in a spiral pattern about all of the rods.

4. A golf club constructed in accordance with claim 1 wherein the tie member is configured in a zigzag pattern with respect to the rods.

5. A golf club constructed in accordance with claim 1 wherein the tie member is configured in a sinusoidal pattern with respect to the rods.

6. A golf club constructed in accordance with claim 1 wherein a plurality of tie members are provided, each tie member spanning at least two adjacent rods at a plurality of spaced intersections along the length of the rods.

7. A golf club constructed in accordance with claim 1 wherein the rods are formed of tubular material.

8. A golf club constructed in accordance with claim 1 wherein the rods are of a diameter within a range of between 3/1000 of an inch to 4/100 of an inch.

9. A golf club constructed in accordance with claim 1 wherein the rods and the tie member are formed of metal, the tie member and the rods being joined at overlying intersections by spot welds.

10. A golf club constructed in accordance with claim 1 wherein the tie member is wrapped about the outer face of the shaft.

11. A golf club constructed in accordance with claim 1 wherein the tie member is wrapped about the inner face of the shaft.

12. A golf club constructed in accordance with claim 1 wherein the tie member is woven between the inner and outer faces of adjacent rods.

13. A golf club constructed in accordance with claim 1 wherein the rods are formed of solid material.

14. A golf club constructed in accordance with claim 1 including a plurality of rods formed of tubular material and a plurality of rods formed of solid material.

15. A golf club constructed in accordance with claim 1 wherein the spaces between the rods are at least as great as the thickness of the rods over a major portion of the length of the shaft.

16. A golf club constructed in accordance with claim 1 wherein the rods are skewed with respect to the longitudinal axis.

17. A golf club constructed in accordance with claim 1 wherein the one tie member spans between all of the rods.

18. A lightweight shaft for a sporting implement, the implement having grip means for holding the shaft adjacent one end thereof and means adjacent the other end of the shaft for engaging an object during implement manipulation in conjuction with sport participation, the shaft comprising a skeletal air-permeable frame, the frame including from five to thirty spaced apart rods arranged longitudinally about a longitudinal axis and means integrally interconnecting the rods to provide unitary coaction of the rods as a single shaft, the interconnecting means including at least one coninuous tie member spanning at least two adjacent rods at a plurality of spaced intersections along the length of each of the two rods and means unitarily joining the tie member to each of the two rods.

19. A shaft constructed in accordance with claim 18 wherein the means integrally interconnecting the rods comprises at least one tie member oriented transversely with respect to the rods and means securing the tie member to the rods at each intersection.

20. A shaft constructed in accordance with claim 19 wherein the tie member is configured in a spiral pattern with respect to the rods.

21. A shaft constructed in accordance with claim 20 wherein the tie member is wrapped about the outer face of the shaft.

22. A shaft constructed in accordance with claim 21 wherein the tie member is wrapped about the inner face of the shaft.

23. A shaft constructed in accordance with claim 18 wherein the spaces between the rods are at least as great as the thickness of the rods over a major portion of the length of the shaft.

24. A shaft constructed in accordance with claim 18 wherein the rods are skewed with respect to the longitudinal axis.

25. A shaft constructed in accordance with claim 18 wherein the rods are of a thickness between 3/1000 of an inch to 4/100 of an inch.

* * * * *